United States Patent [19]

Schifman

[11] 3,989,253

[45] Nov. 2, 1976

[54] GAME BOARD APPARATUS

[75] Inventor: Edward J. Schifman, Nashville, Tenn.

[73] Assignee: Aladdin Industries, Incorporated, Chicago, Ill.

[22] Filed: Dec. 15, 1975

[21] Appl. No.: 640,397

Related U.S. Application Data

[63] Continuation of Ser. No. 525,389, Nov. 20, 1974, abandoned.

[52] U.S. Cl. ..... 273/131 B; 273/131 KC; 273/137 R

[51] Int. Cl.[2] ..... A63F 3/00

[58] Field of Search ..... 273/131

[56] References Cited

UNITED STATES PATENTS 3,820,791 6/1974 Powers ..... 273/131 B 3,825,267 7/1974 Rubinoff ..... 273/131 B

*Primary Examiner*—Delbert B. Lowe

*Attorney, Agent, or Firm*—McDougall, Hersh & Scott

[57] ABSTRACT

A game board apparatus is disclosed for playing a variant of the game of checkers. The game board is similar to a checkerboard, having alternating light and dark colored squares or alternatively, plain and textured squares. Unlike checkers, however, the two center rows of the game board are replaced by a channel adapted to receive two rows of vector tiles therein. The vector tiles alter the normal movement of playing pieces thereon. A piece landing on a vector tile is constrained to move only in the directions indicated by the particular directional indicia on the tile. At the start of each game, the vector tiles are removed from the channel and replaced in a different order thereby to vary the movement constraints for the next game.

3 Claims, 11 Drawing Figures

GAME BOARD APPARATUS

This is a continuation of application Ser. No. 525,389 filed Nov. 20, 1974, now abandoned.

BACKGROUND OF THE INVENTION

The present invention relates to a game board and the associated equipment necessary for playing a game thereon. In particular, the equipment is adapted for playing a variation of the game of checkers. Checkers, although an enjoyable parlor game, tends to become unduly repetitious due to the fixed rules of the game and layout of the board. This is particularly so when the same players regularly oppose each other. Another drawback of checkers is that the level of strategy involved and the opportunities for applying strategy are severely limited.

Variations on checker-type games are known, as for example, U.S. Pat. No. 1,400,520 to Bugenhagen. In this game a fixed obstacle is printed on a checkerboard. This obstacle or cruciform permits a piece landing on a square adjacent the cruciform to move to any other square adjacent to the cruciform. The equipment permits no possibility of varying the arrangement for each new game.

In U.S. Pat. Nos. 1,526,017 to Searle and 2,162,876 to Barton, various barrier type games are disclosed. In Barton, removable tiles are utilized to fit over discrete areas of the game board. As the game progresses, increasing numbers of barriers are placed on the game board with the object of completely boxing in one player. In Searle, immovable preprinted L-shaped barriers are utilized to disrupt the movement of playing pieces on an oversized playing board. See also U.S. Pat. No. 3,820,791 assigned to the present assignee and directed to a vector tile game.

It is accordingly an object of the present invention to provide a variation of the game of checkers in which the game board is varied before each game so that interest in the game is maintained at a higher level and for a longer period of time.

It is another object of the present invention to provide a variation of the game of checkers introducing an additional element for controlling the moves of the playing pieces whereby the permissible moves are different for each game.

It is another object of the present invention to provide a variation of the game of checkers wherein the placement of direction limiting tiles on the game board involves the use of strategy and subsequent movement of playing pieces onto these tiles requires deeper insight into the ramifications thereof than is required in a checkers game.

Other objects and advantages of the invention will be apparent from the concluding portion of the specification.

SUMMARY OF THE INVENTION

The present specification discloses a game board apparatus including a game board similar to a checkerboard except that the center two rows are omitted. In place of the center two rows, a channel is provided for receiving two rows of vector tiles therein. The vector tiles have two or more directions indicated on them from among eight possible directions, namely, vertically up and down, horizontally left or right, and the four diagonal directions.

the game is played with the same number of playing pieces, preferably transparent playing pieces, as in the game of checkers. When a playing piece moves onto one of the vector tiles, it is thereafter constrained to move only in the directions indicated by the vectors on the tile. In some cases this may hinder movement while in other cases it may permit additional degrees of freedom in that a game piece can move backwards if a vector tile so permits.

DETAILED DESCRIPTION

Figure 1:
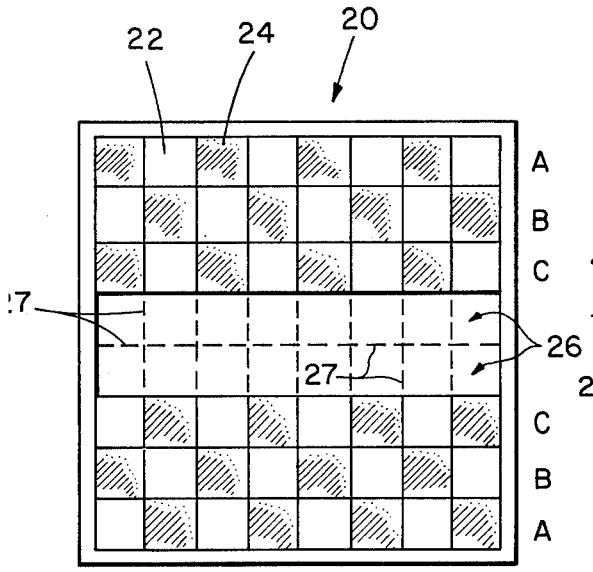
FIG. 1 is a plan view of the game board according to the present invention.

Referring now to FIGS. 1–7, the game board equipment according to the present invention is illustrated. The equipment includes a game board 20 having a plurality of discrete playing areas, preferably squares, thereon and arranged in a row and column manner; that is, there are three rows, A, B and C of discrete squares on either side of the board. As in checkers, every other square in a row is differentiated by being of a different color, texture or otherwise shaded to distinguish it from the immediately adjacent square in that row. Thus, for example, square 22 may be clear while square 24 may be textured or of a different color.

Unlike a standard checkerboard, the present game board 20 does not have permanent rows of squares across the entire surface. The middle two rows of a normal checkerboard are omitted and in their place a depression or channel 26 is provided. The channel 26 has a plurality of grooves 27 therein to define discrete locations for the reception of vector tiles such as vector tile 28 illustrated in FIG. 3.

Figure 2:
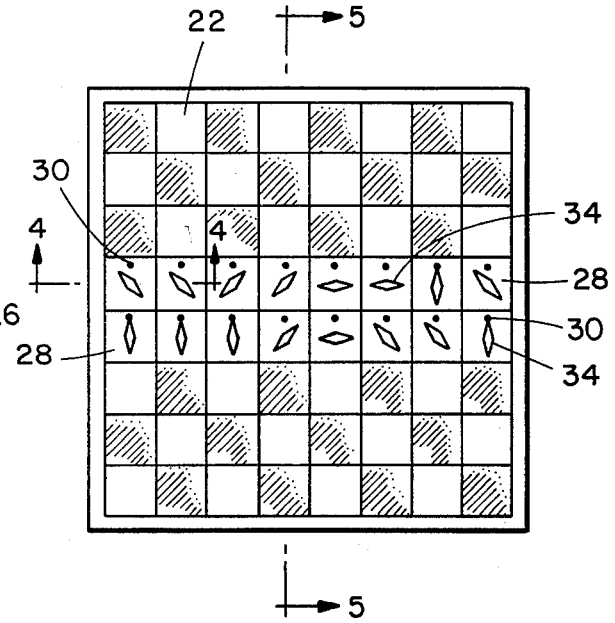
FIG. 2 is a plan view of the game board after the vector tiles have been placed in the recessed channel.

It will be appreciated from a comparison of FIGS. 1 and 2 that prior to playing the game, a plurality of vector tiles, preferably 16, are placed in the channel 26, each vector tile being placed over one of the discrete areas defined by the grooves 27. When the vector tiles have been so placed, the board appears as indicated in FIG. 2. It will be noted that all of the vector tiles are placed in the channel with an orienting mark or dot 30 facing towards the same side of the board.

Figure 3:
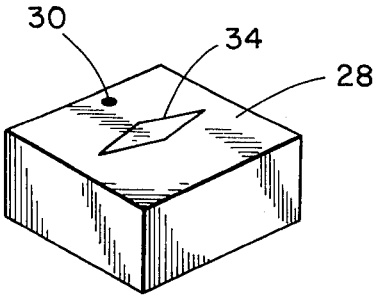
FIG. 3 is a perspective view of a vector tile.
Figure 4:
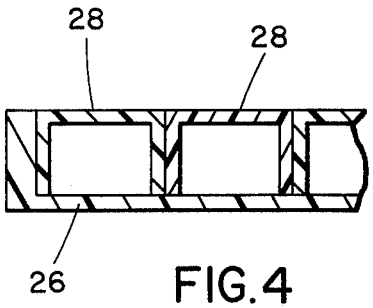
FIG. 4 is a sectional view taken along the lines 4—4 of FIG. 2.
Figure 5:
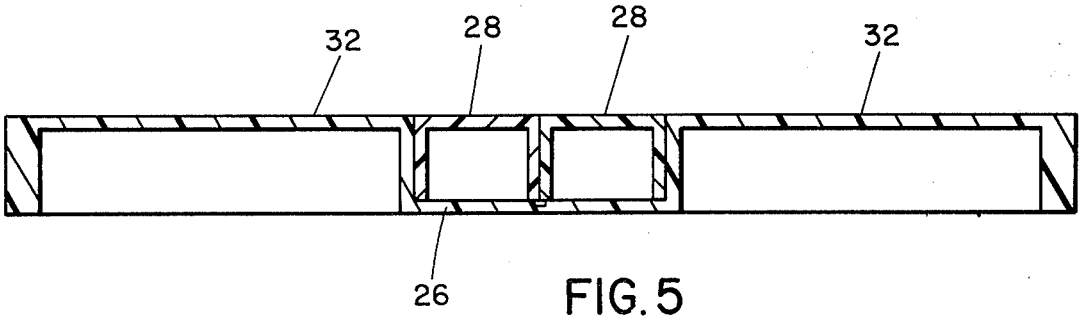
FIG. 5 is a sectional view taken along the lines 5—5 of FIG. 2.
Figure 8:
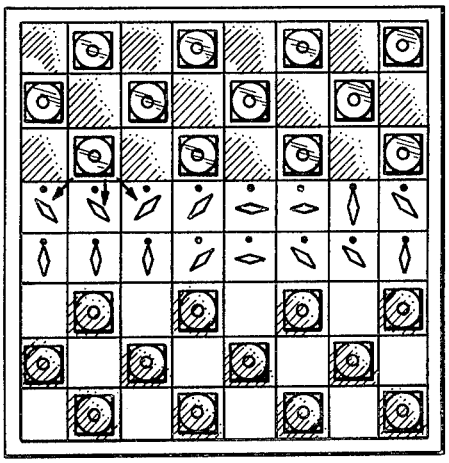
FIG. 8 is a plan view of the game board having the vector tiles therein and the playing pieces in the starting position.
Figure 9:
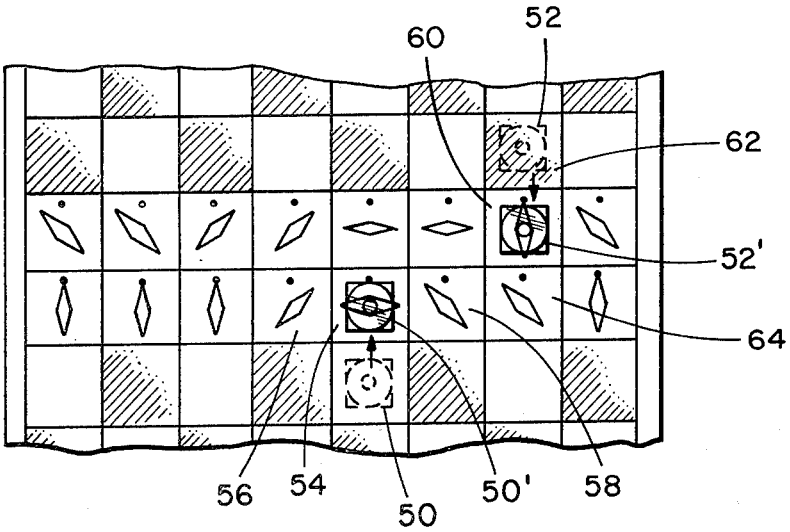
FIG. 9 is a partial plan view illustrating movement of the playing pieces on the vector tiles.
Figure 10:
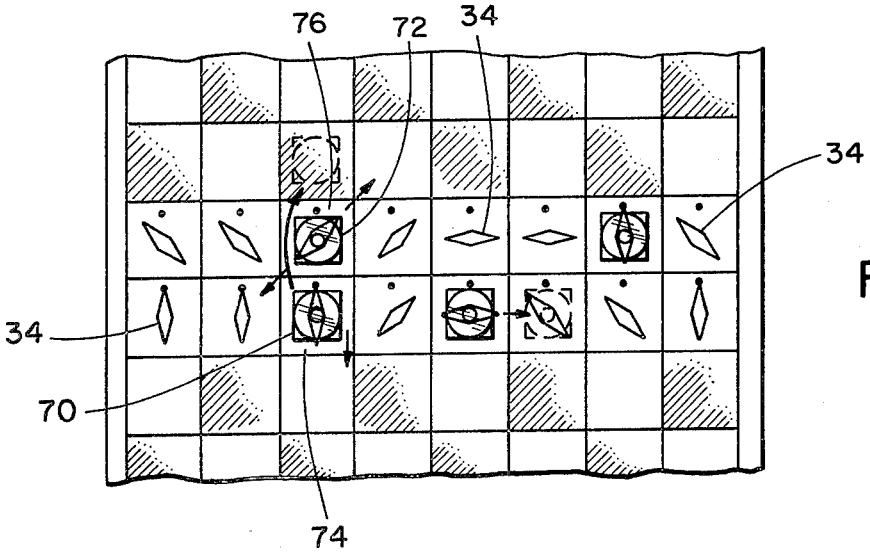
FIG. 10 is a view similar to FIG. 9 illustrating further details of movement of the playing pieces on the vector tiles.

Referring to FIG. 5, a cross section through the game board of FIG. 2 is indicated showing a preferred construction of the game board in order to facilitate low cost manufacture. Preferably the standard checkerboard columns are printed or embossed on raised surfaces 32 on either side of the channel 26. Preferably the raised surfaces are hollow underneath to reduce the amount of material necessary to manufacture the game board. Similarly, as indicated in FIG. 4, the vector tiles 28 are also manufactured as hollow squares. It will be appreciated that the game board, the vector tiles as well as the playing pieces, to be described, can all be manufactured from various materials such as plastic, wood, etc., and, in the case of plastic, the equipment can be turned out by stamping, extrusion, molding, or other well known techniques.

the 16 vector tiles, such as vector tile 28 of FIG. 3, have embossed thereon the orientating dot 30 indicating the position in which the tile must be placed on the board and a vector 34. The vector 34 defines for each tile the directions in which a playing piece resting thereon may be moved. Various examples of this are indicated in FIGS. 8–10 but a perusal of FIG. 2 indicates that when the vector tiles are correctly placed in the channel, an impediment to normal movement of the playing pieces is presented. In effect, the vector tiles control the movement thereacross and form an obstacle or barrier to normal movement of the playing pieces.

Before the playing of each game, the vector tiles are removed from the channel and, depending upon the rules in effect, are replaced in various different combinations, either one at a time by alternating players to permit strategy or by sheer chance placement of the tiles whereby they are picked up one at a time and placed into the channel without looking at them.

Figure 6:
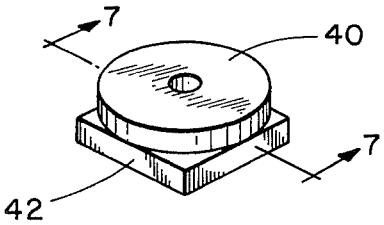
FIG. 6 is a perspective view of a playing piece according to the present invention.
Figure 7:
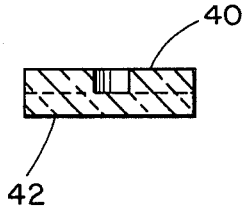
FIG. 7 is a sectional view through a playing piece along the lines 7—7 of FIG. 6.

Referring now to FIGS. 6 and 7, one of the playing pieces adapted for use with the present invention is illustrated. The playing pieces are preferably formed from a plastic material, as is the game board, and may be molded or otherwise produced. The playing pieces preferably have a doughnut shaped portion 40 attached to a square portion 42. Preferably the diameter of the doughnut shaped portion 40 is equal to the width and length dimension of the square 42.

The shape of the playing pieces can differ from this; the only purpose in differentiating the top and bottom of the playing pieces is that inversion or reversal of a playing piece must indicate the piece is upside down. In the game, the inversion of a playing piece so that the doughnut-shaped member 40 is on the bottom indicates that the piece has crossed the entire board and become a "king" as defined in the ordinary game of checkers. By providing such a vertically differentiated playing piece it is not necessary to place one playing piece on top of another to indicate a king as is commonly done in checkers.

As indicated by FIG. 7, the playing pieces can be of a one-piece molded construction. An important aspect of the playing pieces is that they be transparent so that when they are on the vector tiles, the permissible directions of movement can be seen through the playing pieces. In order to differentiate between each side's playing pieces, it is preferable that one set of playing pieces be of clear material while the other set of playing pieces be of a slightly tinted material which, although permitting observation of the vector tiles, differentiates them from the clear playing pieces. It has been found that a yellowish-tinted playing piece is ideal for this purpose.

Referring now to FIGS. 8–11, the rules of the game will be explained along with additional details of the equipment. At the outset it should be noted that while the playing pieces are set up on the board in the same manner as checkers, the permissible moves for each playing piece, when not controlled by the vector tiles, differs from checkers. Each playing piece can move straight forward or diagonally forward, whereas in checkers, the playing pieces can only move diagonally forward.

To begin playing the game, preferably the players remove the barrier tiles from the channel 26 and then, depending on whether they are to be returned to the channel by random selection or by strategic placement, they are place one at a time in the channel. The players alternate placing the vector tiles in the channel. When all of the vector tiles have been placed in the channel, the playing pieces are then positioned on the playing surface as shown in FIG. 8. There are 12 playing pieces for each player, and they are initially arranged in the manner of a checkers game.

To begin play, each player is allowed to move one of his playing pieces in one of the three forward directions. A piece may move on any square whether textured or clear. As soon as a piece moves onto a vector tile, however, that piece can no longer move in the normal manner but can only move in the directions indicated by the vector 34 on the tile. Further, the piece can jump only in the directions permitted by the vector 34. A playing piece which passes through the barrier to the opponent's side is made a "king" if it reaches the very last row on the opponent's side. When this happens, the piece is inverted so that the square portion 42 is upward to identify it as a king. A king can move in any direction forward and back on any square unless and until it is moved onto the vector tiles. On the vector tiles a king, as is a regular piece, is constrained to move only in the directions permitted by the particular vector tile.

Jumping another player in this game is similar to checkers; however, a player may jump or refrain from jumping as he sees fit. In the vector tile rows, it is possible that a situation can be set up, because of the vectors, where one player can jump the other but not vice versa (see FIG. 10). When a regular playing piece lands on a vector tile which indicates movement in a backward direction, that piece can so move in spite of the fact that otherwise regular playing pieces can only move in the forward directions.

Referring to FIG. 9, there is illustrated the movements of playing pieces 50 and 52 onto different vector tiles. Playing piece 50, after landing on vector tile 54, can on subsequent moves, move only onto vector tile 56 or 58. Similarly, playing piece 52, after landing on vector tile 60 can only move back to square 62 or forward to vector tile 64.

It will be seen that where a playing piece must move onto another vector tile, further constraints on future movements are imposed upon the playing piece. Thus in effect, a playing piece can become stuck or entangled in the barrier formed by the vector tiles. This introduces a new and exciting element into the game which requires skill on the part of the players to anticipate the sequence of moves that will result from an initial move onto a vector tile. Furthermore, in an attempt to capture or jump another player's piece on the vector tiles, it will be necessary for a player to anticipate the other player's responses and forced moves due to the vectors. Since the vectors are changed at the beginning of each game, a constantly challenging and continually changing game is presented.

Referring now to FIG. 10, a situation wherein playing piece 70 can jump playing piece 72, not vice versa, is illustrated. Since the playing piece 70 is on vector tile 74, it can jump playing piece 72. Playing piece 72, however, is constrained to move only diagonally forward or backward by the vector tile 76 and accordingly, cannot jump playing piece 70.

Figure 11:
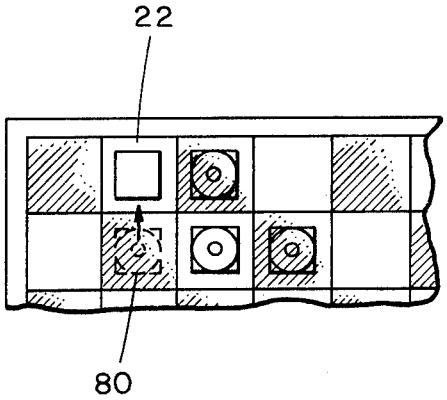
FIG. 11 is a view illustrating the manner in which a playing piece is "kinged" when it reaches the far end of the playing surface.

Finally, referring to FIG. 11, the process of "kinging" a playing piece is illustrated. Playing piece 80, having reached the last row of the opponent's side of the board, is flipped over so that the square portion 42 is up and is then regarded as a king. It can then move in any direction on the regular tiles to jump the opponent's playing pieces as in the regular game of checkers.

While I have shown and described embodiments of this invention in some detail, it will be understood that this description and accompanying illustrations are offered merely by way of example, and that the invention is to be limited in scope only by the appended claims.

I claim:

1. A game comprising:

a. a standard checkerboard having the two middle rows omitted, said board being a one piece construction and having a pair of flat surfaces on which the rows and columns are disposed except for the omitted middle rows, said pair of surfaces being separated from each other by a recessed channel, said recessed channel having discrete tile receiving areas thereon;

b. a plurality of rectangular vector tiles each having on its top surface one or more directional indicia, said tiles forming the two middle rows of said checkerboard when placed on said tile receiving areas thereby to connect the pair of flat playing surfaces and form a checkerboard having the standard number of rows and columns;

c. two sets of transparent playing pieces for movement over said playing surface, one set for each player and each set distinguishable from the other;

each vector tile controlling the subsequent direction of movement of a playing piece situated thereon, at least some of the indicia differing from tile to tile.

2. A gam according to claim 1 wherein said vector tiles have an aligning mark on said top surface to permit placing all tiles in said channel with the same orientation.

3. A game according to claim 1, wherein said playing pieces have distinguishable upper and lower portions thereby to differentiate between a right side up and an upside down playing piece.

* * * * *